US006865342B2

(12) United States Patent
Hirata et al.

(10) Patent No.: US 6,865,342 B2
(45) Date of Patent: Mar. 8, 2005

(54) OPERATION LEVER APPARATUS

(75) Inventors: Minoru Hirata, Kanagawa-ken (JP); Kazuko Matsuoka, Kanagawa-ken (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/186,409

(22) Filed: Jul. 1, 2002

(65) Prior Publication Data

US 2003/0007798 A1 Jan. 9, 2003

(30) Foreign Application Priority Data

Jul. 3, 2001 (JP) ..... 2001-202723
Jul. 1, 2002 (JP) ..... 2002-191783

(51) Int. Cl.[7] ..... G03B 17/00; H04N 5/232
(52) U.S. Cl. ..... 396/85; 348/211.7
(58) Field of Search ..... 345/161; 396/85; 348/211.7, 211.99; D14/412

(56) References Cited

U.S. PATENT DOCUMENTS 4,584,510 A * 4/1986 Hollow ..... 318/584
4,748,441 A * 5/1988 Brzezinski ..... 345/161
4,945,367 A * 7/1990 Blackshear ..... 396/427
5,995,104 A * 11/1999 Kataoka et al. ..... 345/848
H1822 H * 12/1999 Kelley et al. ..... 180/333

OTHER PUBLICATIONS

Panasonic, Panasonic Facilitates Use of Multi–Purpose Convertible Cameras with Major New Accessories, Apr. 22, 2001.*

Operating Instructions: Multi–Function Controller Model AW–RP605, Jun. 11, 2002.*

Panasonic: 3CCD Convertible Camera & Pan tilt Systems, Jun. 11, 2002.*

Panasonic: broadcast & professional video, Jun. 11, 2002.*

* cited by examiner

*Primary Examiner*—Judy Nguyen
*Assistant Examiner*—Arthur A Smith
(74) *Attorney, Agent, or Firm*—Pearne & Gordon LLP

(57) ABSTRACT

Herein disclosed is an operation lever apparatus which comprises a retaining member having a reference axis, a first operation lever having a reference axis and mounted on the retaining member, the first operation lever being movable with respect to the retaining member to assume two different operation positions including a first position in which the reference axis of the first operation lever is held in coaxial relationship with the reference axis of the retaining member, and a second position in which the reference axis of the first operation lever is tilted with respect to the reference axis of the retaining member, first detecting means for detecting a tilt direction of the reference axis of the first operation lever with respect to the reference axis of the retaining member, a second operation lever having a reference axis and mounted on the first operation lever, the second operation lever being movable with respect to the first operation lever to assume two different operation positions including a first position in which the reference axis of the second operation lever is held in coaxial relationship with the reference axis of the first operation lever, and a second position in which the reference axis of the second operation lever is tilted with respect to the reference axis of the first operation lever, and second detecting means for detecting a tilt direction of the reference axis of the second operation lever with respect to the reference axis of the first operation lever.

9 Claims, 13 Drawing Sheets

OPERATION LEVER APPARATUS

BACKGROUND OF THE INVENTION

1. Field of the Invention

The present invention relates to an operation lever apparatus, and more particularly to an operation lever apparatus which comprises an operation lever operative to issue a plurality of instruction signals to other associated devices and arrangements under the state that the operation lever is handled by one hand of an operator.

2. Description of the Related Art

Up until now, there have been proposed a wide variety of conventional operation lever apparatuses each of which comprises a joystick type of operation lever operative to issue a plurality of instruction signals to other associated devices and arrangements, such as a surveillance camera and a game machine, under the state that the operation lever is handled by one hand of an operator.

The conventional operation lever apparatuses of this type have so far been used for a surveillance system which comprises a surveillance camera available for watching a special room. One typical example of the conventional operation lever apparatus is exemplified and shown in FIGS. 12 and 13. The conventional operation lever apparatus 300 thus proposed comprises a housing member 310 having an operation surface 311 and formed with a housing space therein, first and second operation switches 317 and 318 each provided on the operation surface 311 of the housing member 310, a circuit board 320 accommodated in the housing space of the housing member 310, a detecting unit 330 having a reference axis and provided on the circuit board 320, a operation lever 340 having a reference axis and mounted on the retaining member 330.

Each of the first and second operation switches 317 and 318 is movable with respect to the operation surface 311 of the housing member 310 to assume different switching states. The first operation switch 317 is operative to produce a first switch signal indicative of any one of the switching states of the first operation switch 317 and operative to output the first switch signal to the circuit board 320. The second operation switch 318 is operative to produce a second switch signal indicative of any one of the switching states of the second operation switch 318 and operative to output the second switch signal to the circuit board 320.

The operation lever 340 is movable with respect to the detecting unit 330 to assume two different operation positions including a first position in which the reference axis of the operation lever 340 is held in coaxial relationship with the reference axis of the detecting unit 330, and a second position in which the reference axis of the operation lever 340 is tilted with respect to the reference axis of the detecting unit 330. The operation lever 340 is rockable around the reference axis of the operation lever 340. The operation lever 340 is coupled at one end to the detecting unit 330 to ensure that the operation lever 340 is movable to assume the first and second positions of the operation lever 340 and rockable around the reference axis of the operation lever 340 under the state that the operation lever 340 is handled by one hand of an operator.

The detecting unit 330 is operative to detect a tilt direction of the reference axis of the operation lever 340 with respect to the reference axis of the detecting unit 330 to produce a tilt direction signal indicative of the tilt direction of the reference axis of the operation lever 340. The detecting unit 330 is operative to detect a rock direction of the operation lever 340 with respect to the detecting unit 330 to produce a rock direction signal indicative of the rock direction of the operation lever 340. The detecting unit 330 is operative to output the tilt direction signal and the rock direction signal to the circuit board 320.

The circuit board 320 is designed to issue a plurality of instruction signals to the surveillance camera to control various operations of the surveillance camera. The instruction signals are constituted by the first switch signal produced by the first operation switch 317, the second switch signal produced by the second operation switch 318, the tilt direction signal produced by the detecting unit 330, and the rock direction signal produced by the detecting unit 330.

The circuit board 320 is operative to control a zooming operation of the surveillance camera on the basis of the first switch signal produced by the first operation switch 317, a focusing operation of the surveillance camera on the basis of the second switch signal produced by the second operation switch 318, a shooting direction of the surveillance camera on the basis of the tilt direction signal produced by the detecting unit 330, and another kind of operation of the surveillance camera on the basis of the rock direction signal produced by the detecting unit 330.

The conventional operation lever apparatus described in the above, however, encounters such a problem that the conventional operation lever apparatus is decreased in number of the instruction signals under the state that the operation lever apparatus is handled by one hand of an operator, resulting from the fact that the operation lever is limited in number of the movements thereof.

SUMMARY OF THE INVENTION

It is, therefore, an object of the present invention to provide an operation lever apparatus which can be increased in number of the instruction signals under the state that the operation lever apparatus is handled by one hand of an operator.

It is another object of the present invention to provide an operation lever apparatus which can be operated by one hand of an operator with ease.

In accordance with a first aspect of the present invention, there is provided an operation lever apparatus, comprising: a retaining member having a reference axis; a first operation lever having a reference axis and mounted on the retaining member, the first operation lever being movable with respect to the retaining member to assume two different operation positions including a first position in which the reference axis of the first operation lever is held in coaxial relationship with the reference axis of the retaining member, and a second position in which the reference axis of the first operation lever is tilted with respect to the reference axis of the retaining member; first detecting means for detecting a tilt direction of the reference axis of the first operation lever with respect to the reference axis of the retaining member; a second operation lever having a reference axis and mounted on the first operation lever, the second operation lever being movable with respect to the first operation lever to assume two different operation positions including a first position in which the reference axis of the second operation lever is held in coaxial relationship with the reference axis of the first operation lever, and a second position in which the reference axis of the second operation lever is tilted with respect to the reference axis of the first operation lever; and second detecting means for detecting a tilt direction of the reference axis of the second operation lever with respect to the reference axis of the first operation lever.

The first operation lever may include a handle having a top portion. The second operation lever may be mounted on the top portion of the handle of the first operation lever.

The second operation lever may be axially movable along the reference axis of the second operation lever and operative to assume two different operation states including a pushed state in which the second operation lever is axially moved toward the first operation lever and a released state in which the second operation lever is axially moved away from the first operation lever. The second detecting means may be operative to detect the pushed state of the second operation lever member.

The reference axis of the first operation lever may be tiltable with respect to the reference axis of the first retaining member in first to eighth tilt directions each radially outwardly extending from the reference axis of the first retaining member under the state that the first to eighth tilt directions of the reference axis of the first operation lever are held in equiangularly spaced relationship with each other. The first detecting means may be operative to produce a tilt direction signal indicative of neighboring two or more tilt directions selected from among the first to eighth tilt directions of the reference axis of the first operation lever when the reference axis of the first operation lever is tilted with respect to the reference axis of the first retaining member in any one of neighboring two or more tilt directions selected from among the first to eighth tilt directions of the reference axis of the first operation lever.

The first detecting means may be operative to produce a first tilt direction signal indicative of the first to third tilt directions of the reference axis of the first operation lever when the reference axis of the first operation lever is tilted with respect to the reference axis of the first retaining member in any one of the first to third tilt directions of the reference axis of the first operation lever, and a second tilt direction signal indicative of the fifth to seventh tilt directions of the reference axis of the first operation lever when the reference axis of the first operation lever is tilted with respect to the reference axis of the first retaining member in any one of the fifth to seventh tilt directions of the reference axis of the first operation lever.

The first detecting means may be operative to produce a first tilt direction signal indicative of the first to fourth tilt directions of the reference axis of the first operation lever when the reference axis of the first operation lever is tilted with respect to the reference axis of the first retaining member in any one of the first to fourth tilt directions of the reference axis of the first operation lever, and a second tilt direction signal indicative of the fifth to eighth tilt directions of the reference axis of the first operation lever when the reference axis of the first operation lever is tilted with respect to the reference axis of the first retaining member in any one of the fifth to eighth tilt directions of the reference axis of the first operation lever.

The reference axis of the second operation lever may be tiltable with respect to the reference axis of the first operation lever in first to eighth tilt directions each radially outwardly extending from the reference axis of the first operation lever under the state that the first to eighth tilt directions of the reference axis of the second operation lever are held in equiangularly spaced relationship with each other. The second detecting means may be operative to produce a tilt direction signal indicative of neighboring two or more tilt directions selected from among the first to eighth tilt directions of the reference axis of the second operation lever when the reference axis of the second operation lever is tilted with respect to the reference axis of the second retaining member in any one of neighboring two or more tilt directions selected from among the first to eighth tilt directions of the reference axis of the second operation lever.

The second detecting means may be operative to produce a first tilt direction signal indicative of the first to third tilt directions of the reference axis of the second operation lever when the reference axis of the second operation lever is tilted with respect to the reference axis of the first operation lever in any one of the first to third tilt directions of the reference axis of the second operation lever, and a second tilt direction signal indicative of the fifth to seventh tilt directions of the reference axis of the second operation lever when the reference axis of the second operation lever is tilted with respect to the reference axis of the first operation lever in any one of the fifth to seventh tilt directions of the reference axis of the second operation lever.

The second detecting means may be operative to produce a first tilt direction signal indicative of the first to fourth tilt directions of the reference axis of the second operation lever when the reference axis of the second operation lever is tilted with respect to the reference axis of the first operation lever in any one of the first to fourth tilt directions of the reference axis of the second operation lever, and a second tilt direction signal indicative of the fifth to eighth tilt directions of the reference axis of the second operation lever when the reference axis of the second operation lever is tilted with respect to the reference axis of the first operation lever in any one of the fifth to eighth tilt directions of the reference axis of the second operation lever.

The operation lever apparatus may further comprise camera control means for controlling a surveillance camera, the camera control means being operative to control a shooting direction of the surveillance camera on the basis of the tilt direction of the reference axis of the first operation lever with respect to the reference axis of the retaining member, the camera control means being operative to control a zooming operation of the surveillance camera on the basis of the tilt direction of the reference axis of the second operation lever with respect to the reference axis of the first operation lever.

In accordance with a second aspect of the present invention, there is provided an operation lever apparatus, comprising: a retaining member having a reference axis; an operation lever having a reference axis and mounted on the retaining member, the operation lever being movable with respect to the retaining member to assume two different operation positions including a first position in which the reference axis of the operation lever is held in coaxial relationship with the reference axis of the retaining member, and a second position in which the reference axis of the operation lever is tilted with respect to the reference axis of the retaining member; first detecting means for detecting a tilt direction of the reference axis of the operation lever with respect to the reference axis of the retaining member; an operation wheel supported by the operation lever and rockable with respect to the operation lever to assume three different operation positions including first and second positions opposite to each other, and a home position located between the first and second positions of the operation wheel; and second detecting means for detecting a rock direction of the operation wheel with respect to the operation lever.

The operation lever may include a handle top having a peripheral portion. The operation wheel may be disposed at the peripheral portion of the handle top of the operation lever, the operation wheel having a center axis held in parallel relationship with the reference axis of the operation lever and being rockable around the center axis of the operation wheel.

The operation lever apparatus may further comprises an urging member intervening between the operation lever and the operation wheel to have the operation wheel resiliently urged to assume the home position of the operation wheel.

The operation wheel may have a peripheral portion having a plurality of projections.

The operation lever apparatus may further comprises camera control means for controlling a surveillance camera, the camera control means being operative to control a shooting direction of the surveillance camera on the basis of the tilt direction of the reference axis of the operation lever with respect to the reference axis of the retaining member, the camera control means being operative to control a zooming operation of the surveillance camera on the basis of the rock direction of the operation wheel with respect to the operation lever.

BRIEF DESCRIPTION OF THE DRAWINGS

The features and advantages of an operation lever apparatus according to the present invention will be more clearly understood from the following description taken in conjunction with the accompanying drawings in which.

DESCRIPTION OF THE PREFERRED EMBODIMENTS

Figure 1:
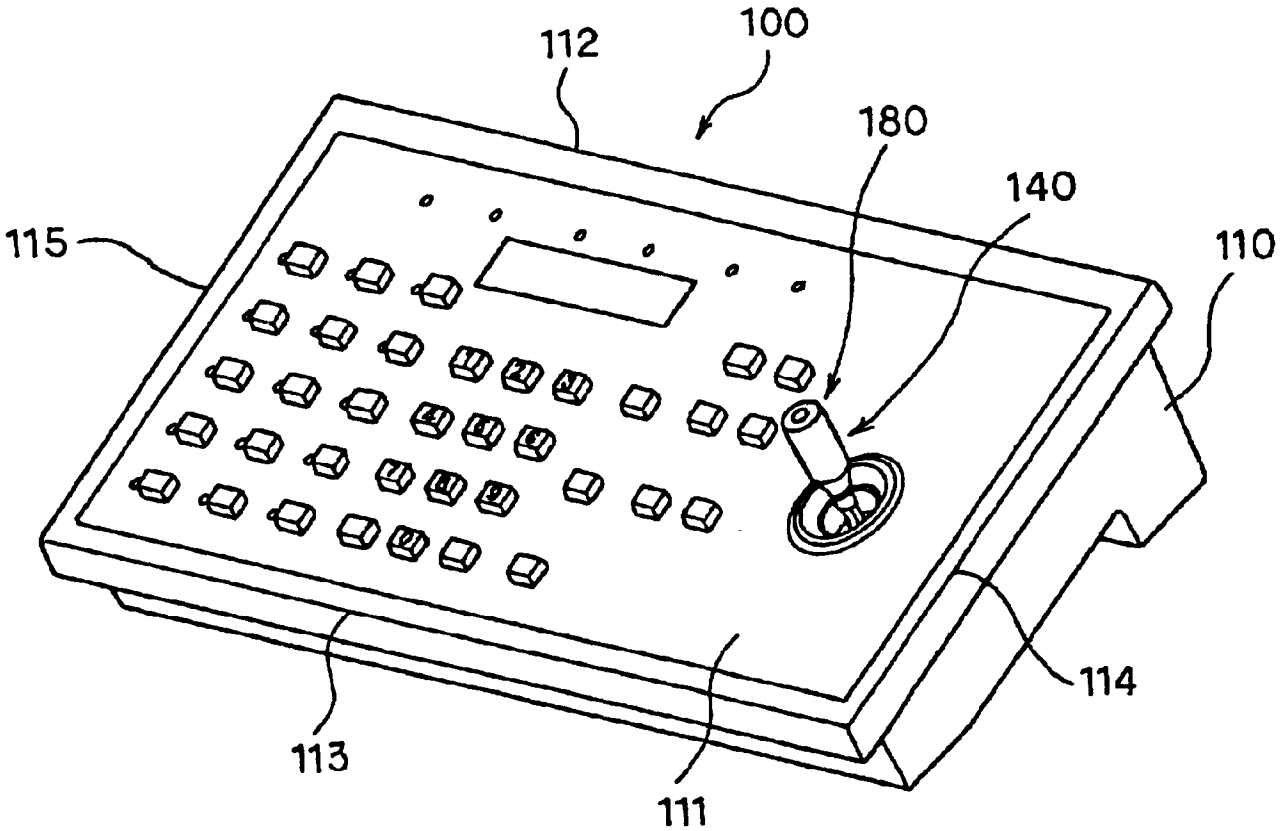
FIG. 1 is a perspective view of a first embodiment of an operation lever apparatus according to the present invention.
Figure 2:
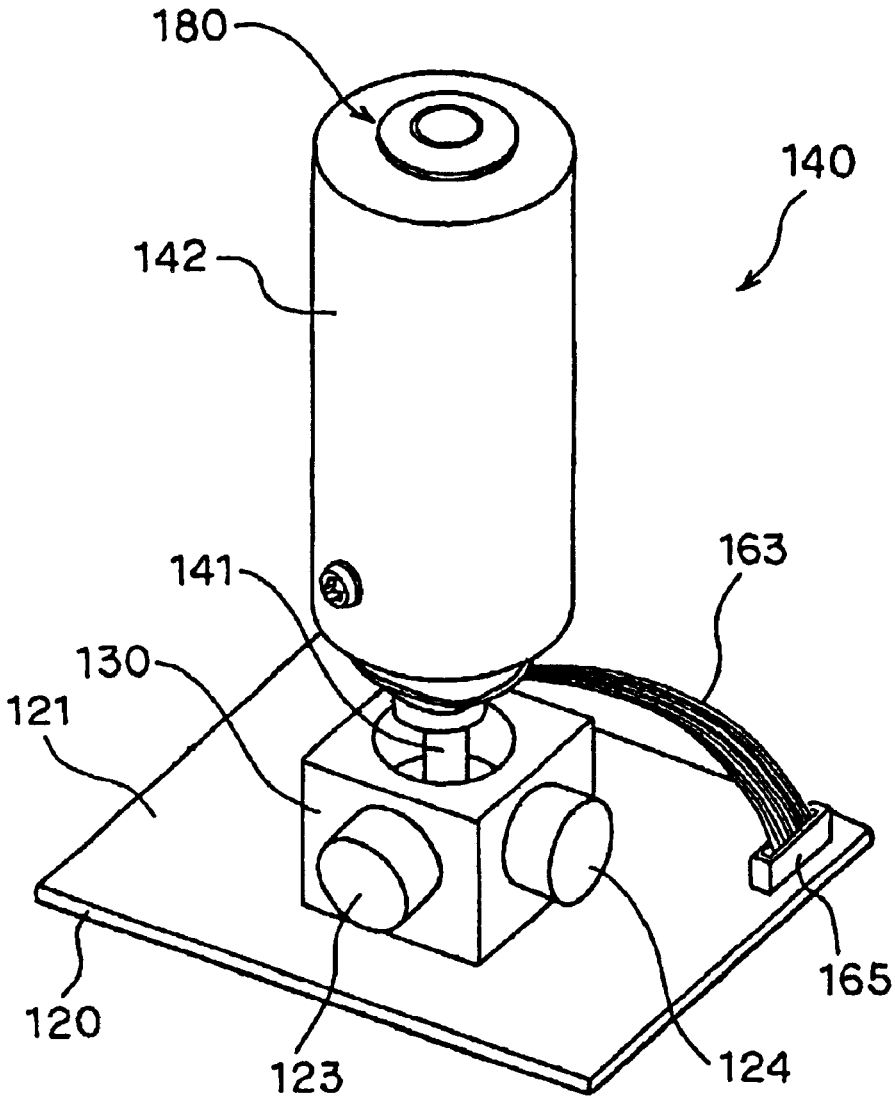
FIG. 2 is a perspective view of a first operation lever, a first detecting unit and a second operation lever forming part of the operation lever apparatus shown in FIG. 1.
Figure 3:
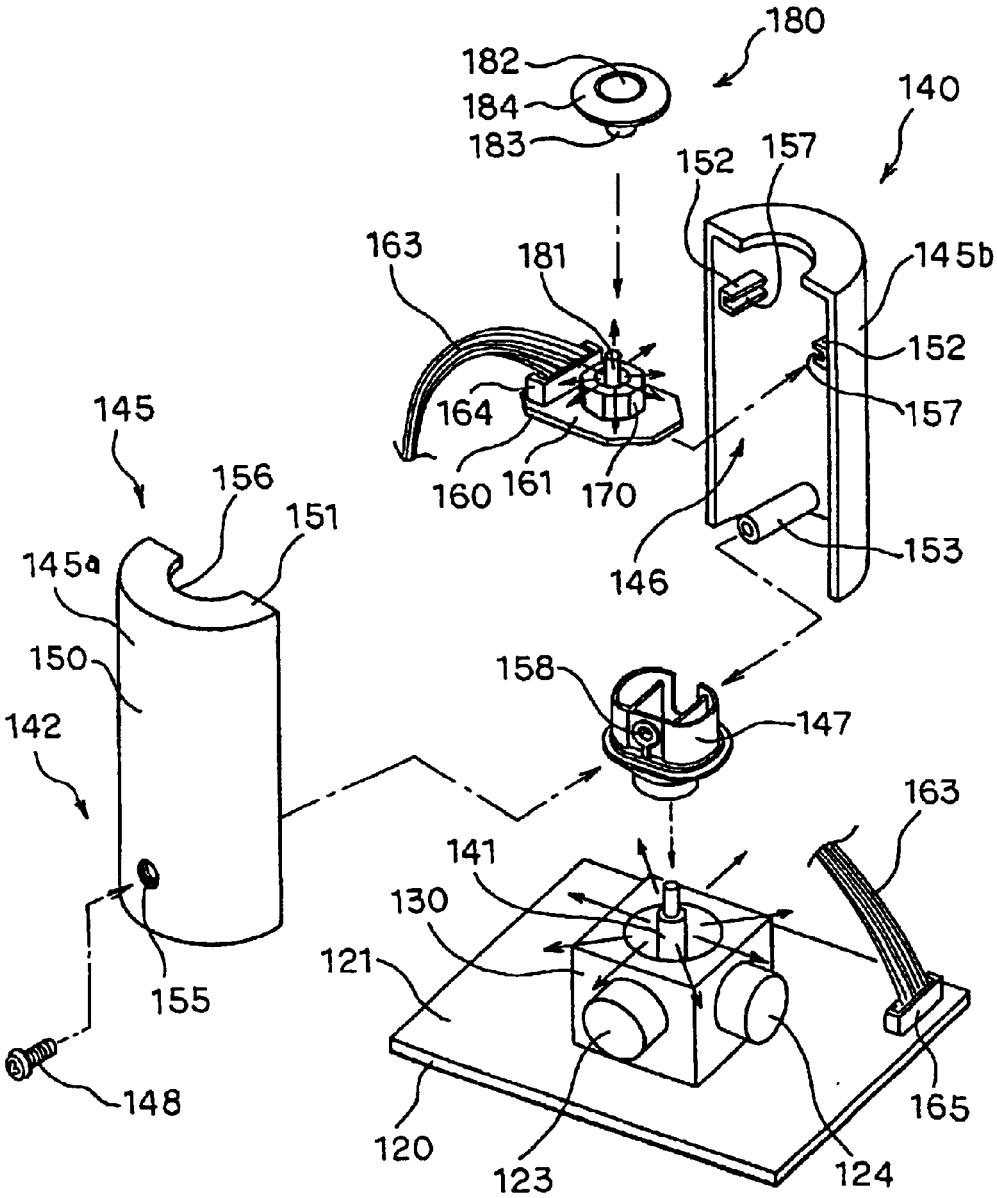
FIG. 3 is an exploded perspective view of a first operation lever, a first detecting unit, a second operation lever and a second detecting unit forming part of the operation lever apparatus shown in FIG. 2.

A first preferred embodiment of the operation lever apparatus according to the present invention will now be described in detail in accordance with the accompanying drawings.

Referring now to the drawings, in particular to FIGS. 1 to 6, there is shown the first preferred embodiment of the operation lever apparatus according to the present invention. The operation lever apparatus 100 is used for a surveillance system which comprises a surveillance camera, not shown, available for watching a special room.

The operation lever apparatus 100 comprises a housing member 110 formed with a housing space and having an operation surface 111 having a front end 112, a rear end 113, a right end 114, and a left end 115, a first circuit board 120 having a flat surface 121 and accommodated in the housing space of the housing member 110 under the state that the flat surface 121 of the first circuit board 120 is held in parallel relationship with the operation surface 111 of the housing member 110, a first retaining member constituted by a first detecting unit 130 having a reference axis and provided on the flat surface 121 of the first circuit board 120 under the state that the reference axis of the first retaining member 130 is held in perpendicular relationship to the flat surface 121 of the first circuit board 120, and a first operation lever 140 having a reference axis and mounted on the first retaining member 130.

The first operation lever 140 is movable with respect to the first detecting unit 130 to assume two different operation positions including a first position in which the reference axis of the first operation lever 140 is held in coaxial relationship with the reference axis of the first detecting unit 130, and a second position in which the reference axis of the first operation lever 140 is tilted with respect to the reference axis of the first detecting unit 130. The first operation lever 140 is resiliently urged by the first detecting unit 130 to have the first operation lever 140 moved to assume the first position of the first operation lever 140.

The first operation lever 140 includes a rod 141 coupled at one end to the first detecting unit 130, and a handle 142 secured to the other end of the rod 141 of the first operation lever 140. The rod 141 of the first operation lever 140 has a center axis held in coaxial relationship with the reference axis of the first operation lever 140. The first operation lever 140 is pivotable around one end of the rod 141 of the first operation lever 140 to ensure that the first operation lever 140 is movable to assume the first and second positions of the first operation lever 140 under the state that the handle 142 of the first operation lever 140 is handled by one hand of an operator.

The handle 142 of the first operation lever 140 includes a cover member 145 formed with a cover space 146, and a coupling member 147 intervening between the rod 141 of the first operation lever 140 and the cover member 145 of the handle 142 of the first operation lever 140 to have the cover member 145 of the handle 142 of the first operation lever 140 supported by the rod 141 of the first operation lever 140 therethrough.

The cover member 145 of the handle 142 of the first operation lever 140 has a side portion 150 in the form of a cylindrical hollow shape and coupled at one end to the other end of the rod 141 of the first operation lever 140 through the coupling member 147 of the handle 142 of the first operation lever 140, a top portion 151 integrally formed with the side portion 150 of the cover member 145 of the handle 142 of the first operation lever 140 and radially inwardly extending from the other end of the side portion 150 of the cover member 145 of the handle 142 of the first operation lever 140, a pair of rib portions 152 each integrally formed with the side portion 150 of the cover member 145 of the handle 142 of the first operation lever 140 and radially inwardly projecting from the side portion 150 of the cover member 145 of the handle 142 of the first operation lever 140, and a boss portion 153 integrally formed with the side portion 150 of the cover member 145 of the handle 142 of the first operation lever 140 and radially inwardly projecting from the side portion 150 of the cover member 145 of the handle 142 of the first operation lever 140.

The boss portion 153 of the cover member 145 of the handle 142 of the first operation lever 140 has a center axis held in perpendicular relationship to the reference axis of the first operation lever 140.

The side portion 150 of the cover member 145 of the handle 142 of the first operation lever 140 is formed with a circular opening 155 having a center axis held in axial alignment with the center axis of the boss portion 153 of the cover member 145 of the handle 142 of the first operation lever 140.

The top portion 151 of the cover member 145 of the handle 142 of the first operation lever 140 is formed with a central hole 156 to have the cover space 146 of the cover member 145 of the handle 142 of the first operation lever 140 held in communication with the exterior of the cover member 145 of the handle 142 of the first operation lever 140 therethrough. The central hole 156 of the top portion 151 of the cover member 145 of the handle 142 of the first operation lever 140 has a center axis held in coaxial relationship with the reference axis of the first operation lever 140.

Each of the rib portions 152 of the cover member 145 of the handle 142 of the first operation lever 140 is formed with a side groove 157 open toward the reference axis of the first operation lever 140.

The cover member 145 of the handle 142 of the first operation lever 140 is constituted by a pair of cover components 145*a* and 145*b* coupled together to collectively form the cover member 145 of the handle 142 of the first operation lever 140.

The coupling member 147 of the handle 142 of the first operation lever 140 is formed with a central hole to have the other end of the rod 141 of the first operation lever 140 received therein. The central hole of the coupling member 147 of the handle 142 of the first operation lever 140 has a center axis held in coaxial relationship with the reference axis of the first operation lever 140.

The coupling member 147 of the handle 142 of the first operation lever 140 is formed with a circular opening 158 having a center axis held in axial alignment with the center axis of the boss portion 153 of the cover member 145 of the handle 142 of the first operation lever 140.

The cover member 145 of the handle 142 of the first operation lever 140 is secured to the coupling member 147 of the handle 142 of the first operation lever 140 by a screw 148 tightened to the boss portion 153 of the cover member 145 of the handle 142 of the first operation lever 140 through the circular opening 155 of the side portion 150 of the cover member 145 of the handle 142 of the first operation lever 140 and the circular opening 158 of the coupling member 147 of the handle 142 of the first operation lever 140.

The operation lever apparatus 100 further comprises first detecting means constituted by a first detecting unit 130 designed to detect a tilt direction of the reference axis of the first operation lever 140 with respect to the reference axis of the first detecting unit 130. The first detecting unit 130 includes a first variable resistor 123, and a second variable resistor 124.

Figure 4:
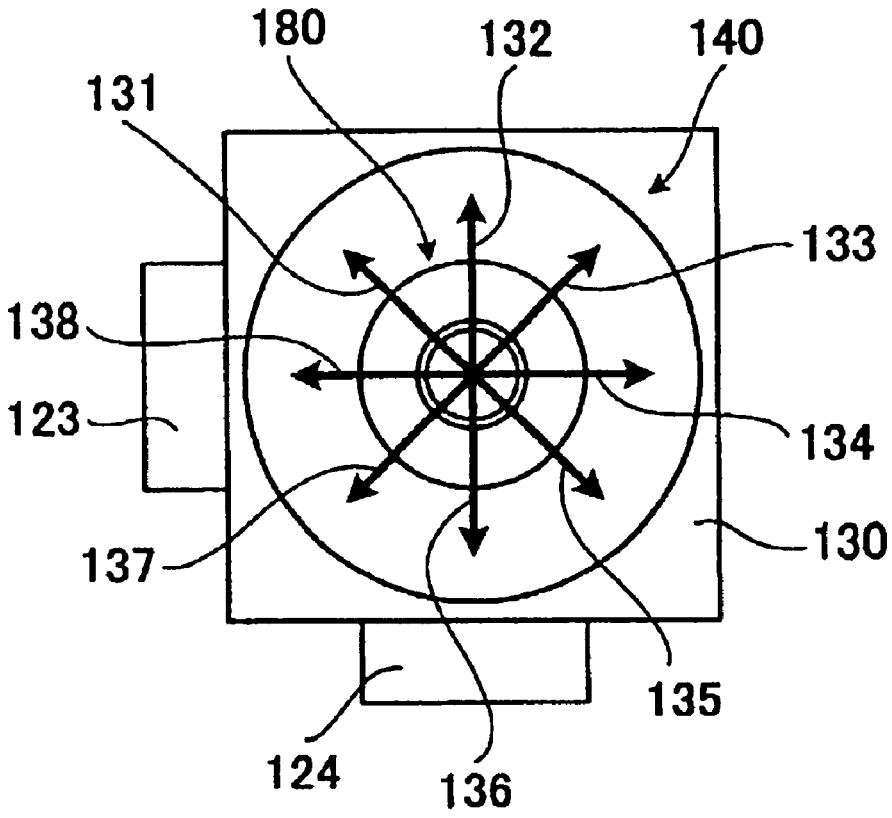
FIG. 4 is an enlarged plan view of a first detecting unit, a first operation lever and a second operation lever forming part of the operation lever apparatus shown in FIG. 2.

The reference axis of the first operation lever 140 is tiltable with respect to the reference axis of the first detecting unit 130 in first to eighth tilt directions 131 to 138 held in equiangularly spaced relationship with each other as shown in FIG. 4.

The second tilt direction 132 of the reference axis of the first operation lever 140 radially outwardly extends from the reference axis of the first detecting unit 130 toward the front end 112 of the operation surface 111 of the housing member 110.

The fourth tilt direction 134 of the reference axis of the first operation lever 140 radially outwardly extends from the reference axis of the first detecting unit 130 toward the right end 114 of the operation surface 111 of the housing member 110.

The sixth tilt direction 136 of the reference axis of the first operation lever 140 radially outwardly extends from the reference axis of the first detecting unit 130 toward the rear end 113 of the operation surface 111 of the housing member 110.

The eighth tilt direction 138 of the reference axis of the first operation lever 140 radially outwardly extends from the reference axis of the first detecting unit 130 toward the left end 115 of the operation surface 111 of the housing member 110.

The first tilt direction 131 of the reference axis of the first operation lever 140 radially outwardly extends from the reference axis of the first detecting unit 130 toward the middle direction between the second and eighth tilt directions 132 and 138 of the reference axis of the first operation lever 140.

The third tilt direction 133 of the reference axis of the first operation lever 140 radially outwardly extends from the reference axis of the first detecting unit 130 toward the middle direction between the second and fourth tilt directions 132 and 134 of the reference axis of the first operation lever 140.

The fifth tilt direction 135 of the reference axis of the first operation lever 140 radially outwardly extends from the reference axis of the first detecting unit 130 toward the middle direction between the fourth and sixth tilt directions 134 and 136 of the reference axis of the first operation lever 140.

The seventh tilt direction 137 of the reference axis of the first operation lever 140 radially outwardly extends from the reference axis of the first detecting unit 130 toward the middle direction between the sixth and eighth tilt directions 136 and 138 of the reference axis of the first operation lever 140.

The first detecting unit 130 is operative to produce a tilt direction signal indicative of any one of the first to eighth tilt directions 131 to 138 of the reference axis of the first operation lever 140 when the reference axis of the first operation lever 140 is tilted with respect to the reference axis of the first detecting unit 130 in any one of the first to eighth tilt directions 131 to 138 of the reference axis of the first operation lever 140. The first detecting unit 130 is operative to output the tilt direction signal produced by the first detecting unit 130 to the first circuit board 120 through a plurality of terminals, not shown.

The first detecting unit 130 may be operative to produce a tilt direction signal indicative of neighboring two or more tilt directions selected from among the first to eighth tilt directions 131 to 138 of the reference axis of the first operation lever 140 when the reference axis of the first operation lever 140 is tilted with respect to the reference axis of the first detecting unit 130 in any one of neighboring two or more tilt directions selected from among the first to eighth tilt directions 131 to 138 of the reference axis of the first operation lever 140.

The first detecting unit 130 may also be operative to produce a first tilt direction signal indicative of the first to third tilt directions 131 to 133 of the reference axis of the first operation lever 140 when the reference axis of the first operation lever 140 is tilted with respect to the reference axis of the first detecting unit 130 in any one of the first to third tilt directions 131 to 133 of the reference axis of the first operation lever 140, and a second tilt direction signal indicative of the fifth to seventh tilt directions 135 to 137 of the reference axis of the first operation lever 140 when the reference axis of the first operation lever 140 is tilted with respect to the reference axis of the first detecting unit 130 in any one of the fifth to seventh tilt directions 135 to 137 of the reference axis of the first operation lever 140.

The operation lever apparatus 100 further comprises a second circuit board 160 having a flat surface 161 and accommodated in the cover space 146 of the cover member 145 of the handle 142 of the first operation lever 140 under the state that the flat surface 161 of the second circuit board 160 is held in perpendicular relationship to the reference axis of the first operation lever 140, and a second retaining member constituted by a second detecting unit 170 having a reference axis and provided on the flat surface 161 of the second circuit board 160 under the state that the reference axis of the second detecting unit 170 is held in coaxial relationship with the reference axis of the first operation lever 140. This means that the reference axis of the second detecting unit 170 is held in perpendicular relationship to the flat surface 161 of the second circuit board 160. The second circuit board 160 is received in the side grooves 157 of the rib portions 152 of the cover member 145 of the handle 142 of the first operation lever 140 and fixedly retained by the cover member 145 of the handle 142 of the first operation lever 140.

The operation lever apparatus 100 further comprises a second operation lever 180 having a reference axis and mounted on the second detecting unit 170. The second operation lever 180 is movable with respect to the second detecting unit 170 to assume two different operation positions including a first position in which the reference axis of the second operation lever 180 is held in coaxial relationship with the reference axis of the second detecting unit 170, and a second position in which the reference axis of the second operation lever 180 is tilted with respect to the reference axis of the second detecting unit 170. This means that the second operation lever 180 is mounted on the first operation lever 140 and movable with respect to the first operation lever 140. The second operation lever 180 is resiliently urged by the second detecting unit 170 to have the second operation lever 180 moved to assume the first position of the second operation lever 180.

The second operation lever 180 includes a rod 181 coupled at one end to the second detecting unit 170, and a button 182 secured to the other end of the rod 181 of the second operation lever 180 and mounted on the top portion 151 of the cover member 145 of the handle 142 of the first operation lever 140. The rod 181 of the second operation lever 180 has a center axis held in coaxial relationship with the reference axis of the second operation lever 180. The second operation lever 180 is pivotable around one end of the rod 181 of the second operation lever 180 to ensure that the second operation lever 180 is movable to assume the first and second positions of the second operation lever 180 under the state that the button 182 of the second operation lever 180 is handled by a thumb of one hand of an operator.

The button 182 of the second operation lever 180 has a boss portion 183 formed with a central hole to have the other end of the rod 181 of the second operation lever 180 received therein, and a top portion 184 integrally formed with the boss portion 183 of the button 182 of the second operation lever 180 and radially outwardly extending from the boss portion 183 of the button 182 of the second operation lever 180. The top portion 184 of the button 182 of the second operation lever 180 is in the form of a circular shape. The central hole of the boss portion 183 of the button 182 of the second operation lever 180 has a center axis held in coaxial relationship with the reference axis of the second operation lever 180.

The operation lever apparatus 100 further comprises second detecting means constituted by a second detecting unit 170 designed to detect a tilt direction of the reference axis of the second operation lever 180 with respect to the reference axis of the second detecting unit 170. The second detecting unit 170 includes first to eighth contact points.

Figure 5:
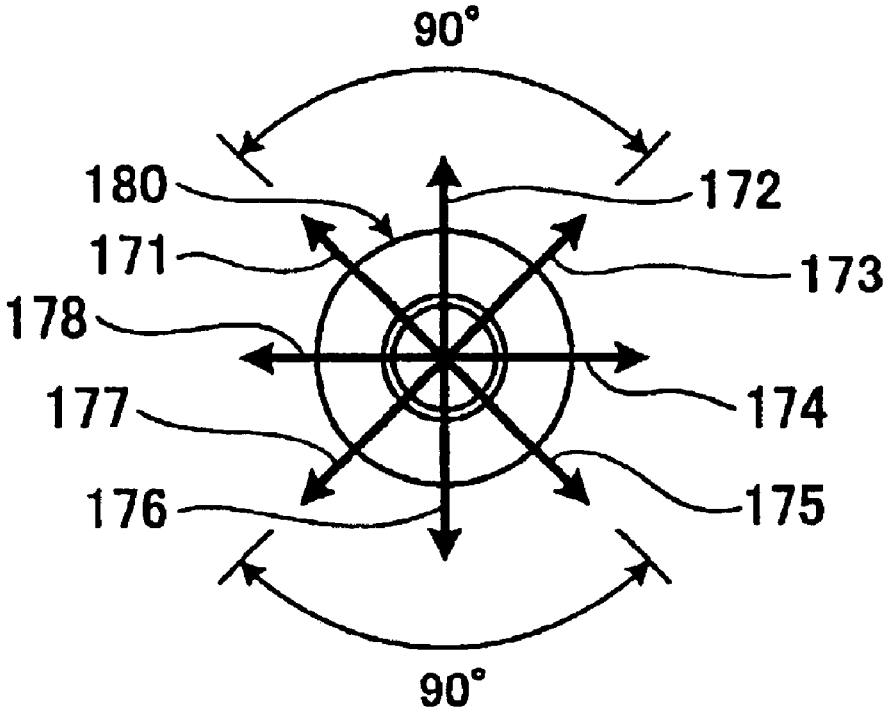
FIG. 5 is an enlarged plan view of a second operation lever forming part of the operation lever apparatus shown in FIG. 2.

The reference axis of the second operation lever 180 is tiltable with respect to the reference axis of the second detecting unit 170 in first to eighth tilt directions 171 to 178 held in equiangularly spaced relationship with each other as shown in FIG. 5.

The second tilt direction 172 of the reference axis of the first operation lever 140 radially outwardly extends from the reference axis of the second detecting unit 130 toward the front end 112 of the operation surface 111 of the housing member 110.

The fourth tilt direction 174 of the reference axis of the first operation lever 140 radially outwardly extends from the reference axis of the second detecting unit 130 toward the right end 114 of the operation surface 111 of the housing member 110.

The sixth tilt direction 176 of the reference axis of the first operation lever 140 radially outwardly extends from the reference axis of the second detecting unit 130 toward the rear end 113 of the operation surface 111 of the housing member 110.

The eighth tilt direction 178 of the reference axis of the first operation lever 140 radially outwardly extends from the reference axis of the second detecting unit 130 toward the left end 115 of the operation surface 111 of the housing member 110.

The first tilt direction 171 of the reference axis of the first operation lever 140 radially outwardly extends from the reference axis of the second detecting unit 130 toward the middle direction between the second and eighth tilt directions 172 and 178 of the reference axis of the first operation lever 140.

The third tilt direction 173 of the reference axis of the first operation lever 140 radially outwardly extends from the reference axis of the second detecting unit 130 toward the middle direction between the second and fourth tilt directions 172 and 174 of the reference axis of the first operation lever 140.

The fifth tilt direction 175 of the reference axis of the first operation lever 140 radially outwardly extends from the reference axis of the second detecting unit 130 toward the middle direction between the fourth and sixth tilt directions 174 and 176 of the reference axis of the first operation lever 140.

The seventh tilt direction 177 of the reference axis of the first operation lever 140 radially outwardly extends from the reference axis of the second detecting unit 130 toward the middle direction between the sixth and eighth tilt directions 176 and 178 of the reference axis of the first operation lever 140.

The second detecting unit 170 is operative to produce a tilt direction signal indicative of any one of the first to eighth tilt directions 171 to 178 of the reference axis of the second operation lever 180 when the reference axis of the second operation lever 180 is tilted with respect to the reference axis of the second detecting unit 170 in any one of the first to eighth tilt directions 171 to 178 of the reference axis of the second operation lever 180.

The second detecting unit 170 may be operative to produce a tilt direction signal indicative of neighboring two or more tilt directions selected from among the first to eighth tilt directions 171 to 178 of the reference axis of the second operation lever 180 when the reference axis of the second operation lever 180 is tilted with respect to the reference axis of the second detecting unit 170 in any one of neighboring two or more tilt directions selected from among the first to eighth tilt directions 171 to 178 of the reference axis of the second operation lever 180.

The second detecting unit 170 may also be operative to produce a first tilt direction signal indicative of the first to third tilt directions 171 to 173 of the reference axis of the second operation lever 180 when the reference axis of the second operation lever 180 is tilted with respect to the reference axis of the second detecting unit 170 in any one of the first to third tilt directions 171 to 173 of the reference axis of the second operation lever 180, and a second tilt direction signal indicative of the fifth to seventh tilt directions 175 to 177 of the reference axis of the second operation lever 180 when the reference axis of the second operation lever 180 is tilted with respect to the reference axis of the second detecting unit 170 in any one of the fifth to seventh tilt directions 175 to 177 of the reference axis of the second operation lever 180 as shown in FIG. 5.

Figure 6:
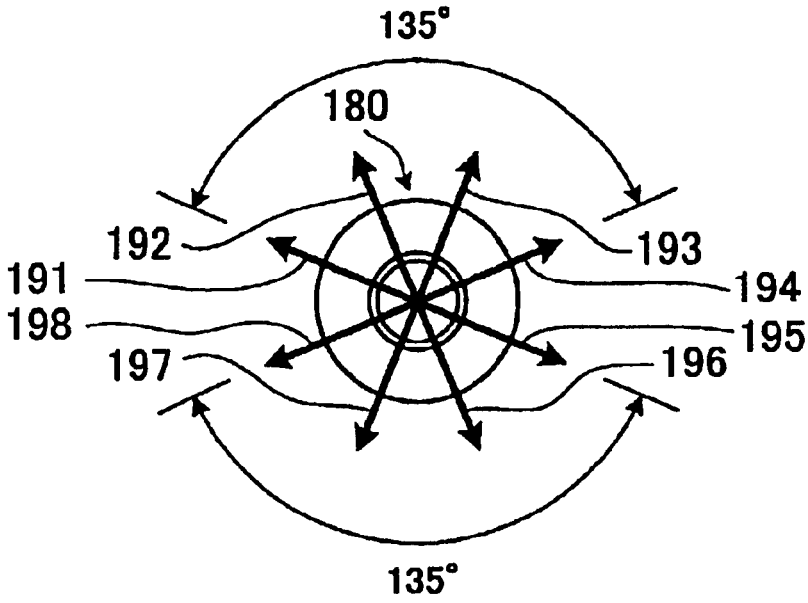
FIG. 6 is an enlarged plan view of a second operation lever forming part of the operation lever apparatus shown in FIG. 2.
Figure 7:
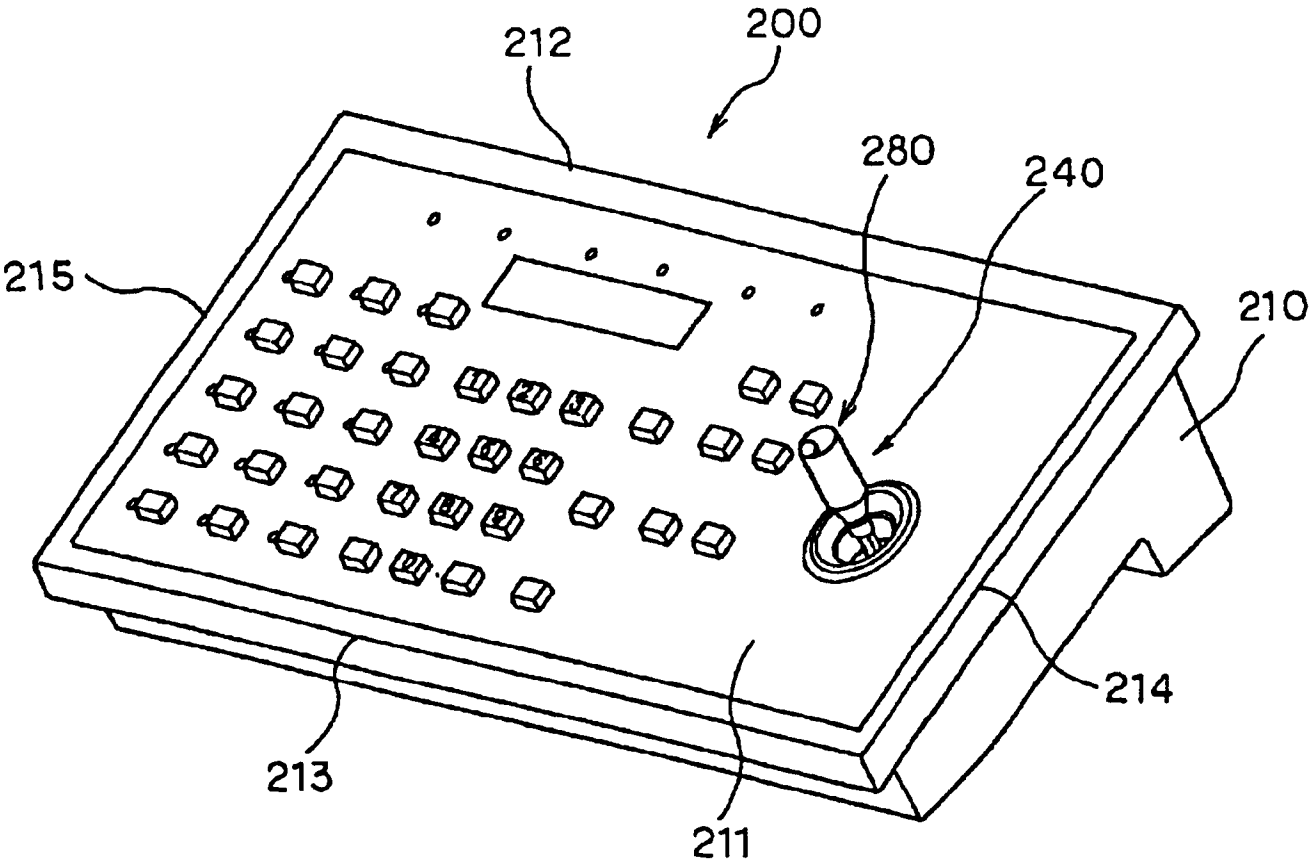
FIG. 7 is a perspective view of a second embodiment of an operation lever apparatus according to the present invention.

The second detecting unit 170 may also be operative to produce a first tilt direction signal indicative of the first to fourth tilt directions 191 to 194 of the reference axis of the second operation lever 180 when the reference axis of the second operation lever 180 is tilted-with respect to the reference axis of the second detecting unit 170 in any one of the first to fourth tilt directions 191 to 194 of the reference axis of the second operation lever 180, and a second tilt direction signal indicative of the fifth to eighth tilt directions 195 to 198 of the reference axis of the second operation lever 180 when the reference axis of the second operation lever 180 is tilted with respect to the reference axis of the second detecting unit 170 in any one of the fifth to eighth tilt directions 195 to 198 of the reference axis of the second operation lever 180 as shown in FIG. 6.

The second operation lever 180 is axially movable along the reference axis of the second operation lever 180 and operative to assume two different operation states including a pushed state in which the second operation lever 180 is axially moved toward the second detecting unit 170 under the state that the button 182 of the second operation lever 180 is pushed by a thumb of one hand of an operator, and a released state in which the second operation lever 180 is axially moved away from the second detecting unit 170 under the state that the button 182 of the second operation lever 180 is released from a thumb of one hand of an operator.

The second detecting unit 170 is operative to detect the pushed state of the second operation lever 180 to produce a pushed state signal indicative of the pushed state of the second operation lever 180 when the second operation lever 180 is operated to assume the pushed state of the second operation lever 180.

The second detecting unit 170 is operative to output the tilt direction signal and the pushed state signal each produced by the second detecting unit 170 to the first circuit board 120 through the second circuit board 160 and a cable 163 electrically connected at one end to the second circuit board 160 through a connector 164 and electrically connected at the other end to the first circuit board 120 through a connector 165.

The operation lever apparatus 100 further comprises camera control means constituted by the first circuit board 120 designed to issue a plurality of instruction signals to the surveillance camera to control various operations of the surveillance camera. The instruction signals are constituted by the tilt direction signal produced by the first detecting unit 130, the tilt direction signal produced by the second detecting unit 170, and the pushed state signal produced by the second detecting unit 170.

The camera control means 120 is operative to control a shooting direction of the surveillance camera on the basis of the tilt direction signal produced by the first detecting unit 130, a zooming operation of the surveillance camera on the basis of the tilt direction signal produced by the second detecting unit 170, and a focusing operation of the surveillance camera on the basis of the pushed state signal produced by the second detecting unit 170.

As will be seen from the foregoing description, the first embodiment of the operation lever apparatus according to the present invention makes it possible 1) to be increased in number of the instruction signals under the state that the operation lever apparatus is handled by one hand of an operator, and 2) to be operated by one hand of an operator with ease.

A second preferred embodiment of the operation lever apparatus according to the present invention will now be described in detail in accordance with the accompanying drawings.

Referring now to the drawings, in particular to FIGS. 7 to 11, there is shown the second preferred embodiment of the operation lever apparatus according to the present invention. The operation lever apparatus 200 is used for a surveillance system which comprises a surveillance camera, not shown, available for watching a special room.

The operation lever apparatus 200 comprises a housing member 210 formed with a housing space and having a operation surface 211 having a front end 212, a rear end 213, a right end 214, and a left end 215, a circuit board 220 having a flat surface 221 and accommodated in the housing space of the housing member 210 under the state that the flat surface 221 of the circuit board 220 is held in parallel relationship with the operation surface 211 of the housing member 210, a retaining member constituted by a first detecting unit 230 having a reference axis and provided on the flat surface 221 of the circuit board 220 under the state that the reference axis of the first detecting unit 230 is held in perpendicular relationship to the flat surface 221 of the circuit board 220, and an operation lever 240 having a reference axis and mounted on the first detecting unit 230.

The operation lever 240 is movable with respect to the first detecting unit 230 to assume two different operation positions including a first position in which the reference axis of the operation lever 240 is held in coaxial relationship with the reference axis of the first detecting unit 230, and a second position in which the reference axis of the operation lever 240 is tilted with respect to the reference axis of the first detecting unit 230. The operation lever 240 is resiliently urged by the first detecting unit 230 to have the operation lever 240 moved to assume the first position of the operation lever 240.

The operation lever 240 includes a rod 241 coupled at one end to the first detecting unit 230, a handle 242 secured at one end to the other end of the rod 241 of the operation lever 240, and a handle top 243 having a peripheral portion 244 and supported by the handle 242 of the operation lever 240 under the state that the peripheral portion 244 of the handle top 243 of the operation lever 240 is provided on the other end of the handle 242 of the operation lever 240. The rod 241 of the operation lever 240 has a center axis held in coaxial relationship with the reference axis of the operation lever 240. The operation lever 240 is pivotable around one end of the rod 241 of the operation lever 240 to ensure that the operation lever 240 is movable to assume the first and second positions of the operation lever 240 under the state that the handle 242 of the operation lever 240 is handled by one hand of an operator.

The handle 242 of the operation lever 240 includes a side cover member 245 formed with a cover space 246, and a coupling member 247 intervening between the rod 241 of the operation lever 240 and the side cover member 245 of the handle 242 of the operation lever 240 to have the side cover member 245 of the handle 242 of the operation lever 240 supported by the rod 241 of the operation lever 240 therethrough.

The side cover member 245 of the handle 242 of the operation lever 240 is in the form of a cylindrical hollow shape and coupled at one end to the other end of the rod 241 of the first operation lever 240 through the coupling member 247 of the handle 242 of the operation lever 240.

The coupling member 247 of the handle 242 of the operation lever 240 is formed with a central hole to have the other end of the rod 241 of the operation lever 240 received therein. The central hole of the coupling member 247 of the handle 242 of the operation lever 240 has a center axis held in coaxial relationship with the reference axis of the operation lever 240. The coupling member 247 of the handle 242 of the operation lever 240 is formed with an annular ledge 248 to have one end of the side cover member 245 of the handle 242 of the operation lever 240 received therein.

The handle top 243 of the operation lever 240 includes a top cover member 250 provided on the other end of the side cover member 245 of the handle 242 of the operation lever 240 and having front and rear end portions 251 and 252, a button member 253 provided on the rear end portion 252 of the top cover member 250 of the handle top 243 of the operation lever 240, a chassis 254 accommodated in the cover space 246 of the side cover member 245 of the handle 242 of the operation lever 240, a switch board 255 provided on the chassis 254 of the handle top 243 of the operation lever 240, a switch unit 256 provided on the switch board 255 of the handle top 243 of the operation lever 240, and a pin 257 secured to the chassis 254 of the handle top 243 of the operation lever 240 and having a center axis held in parallel relationship with the reference axis of the operation lever 240.

The button member 253 of the handle top 243 of the operation lever 240 is axially movable along the reference axis of the operation lever 240 and operative to assume two different operation states including a pushed state in which the button member 253 of the handle top 243 of the operation lever 240 is axially moved toward the first detecting unit 230 under the state that the button member 253 of the handle top 243 of the operation lever 240 is pushed by a thumb of one hand of an operator, and a released state in which the button member 253 of the handle top 243 of the operation lever 240 is axially moved away from the first detecting unit 230 under the state that the button member 253 of the handle top 243 of the operation lever 240 is released from a thumb of one hand of an operator.

The switch unit 256 of the handle top 243 of the operation lever 240 is operative to detect the pushed state of the button member 253 of the handle top 243 of the operation lever 240 to produce a pushed state signal indicative of the pushed state of the button member 253 of the handle top 243 of the operation lever 240 when the button member 253 of the handle top 243 of the operation lever 240 is operated to assume the pushed state of the button member 253 of the handle top 243 of the operation lever 240.

The switch unit 256 of the handle top 243 of the operation lever 240 is operative to output the pushed state signal produced by the switch unit 256 of the handle top 243 of the operation lever 240 to the circuit board 220 through the switch board 255 of the handle top 243 of the operation lever 240 and a cable 263 electrically connected at one end to the switch board 255 of the handle top 243 of the operation lever 240 and electrically connected at the other end to the circuit board 220 through a connector 265.

The chassis 254 of the handle top 243 of the operation lever 240 is formed with a pair of circular openings 258 having a center axis held in perpendicular relationship to the reference axis of the operation lever 240. The chassis 254 of the handle top 243 of the operation lever 240 is formed with a pair of circular openings 259 each having a center axis held in parallel relationship with the reference axis of the operation lever 240. The switch board 255 of the handle top 243 of the operation lever 240 is formed with a pair of circular openings 260 each having a center axis held in parallel relationship with the reference axis of the operation lever 240.

The top cover member 250 of the handle top 243 of the operation lever 240 and the switch board 255 of the handle top 243 of the operation lever 240 are secured to the chassis 254 of the handle top 243 of the operation lever 240 by a pair of screws 261 tightened to the top cover member 250 of the handle top 243 of the operation lever 240 through the circular openings 259 of the chassis 254 of the handle top 243 of the operation lever 240 and the circular openings 260 of the switch board 255 of the handle top 243 of the operation lever 240, respectively.

The chassis 254 of the handle top 243 of the operation lever 240 is secured to the coupling member 247 of the handle 242 of the operation lever 240 by a pair of screws 262 tightened to the coupling member 247 of the handle 242 of the operation lever 240 through the circular openings 258 of the chassis 254 of the handle top 243 of the operation lever 240, respectively.

The operation lever apparatus 200 further comprises first detecting means constituted by the first detecting unit 230 designed to detect a tilt direction of the reference axis of the operation lever 240 with respect to the reference axis of the first detecting unit 230. The first detecting unit 230 includes a first variable resistor 223, and a second variable resistor 224.

Figure 8:
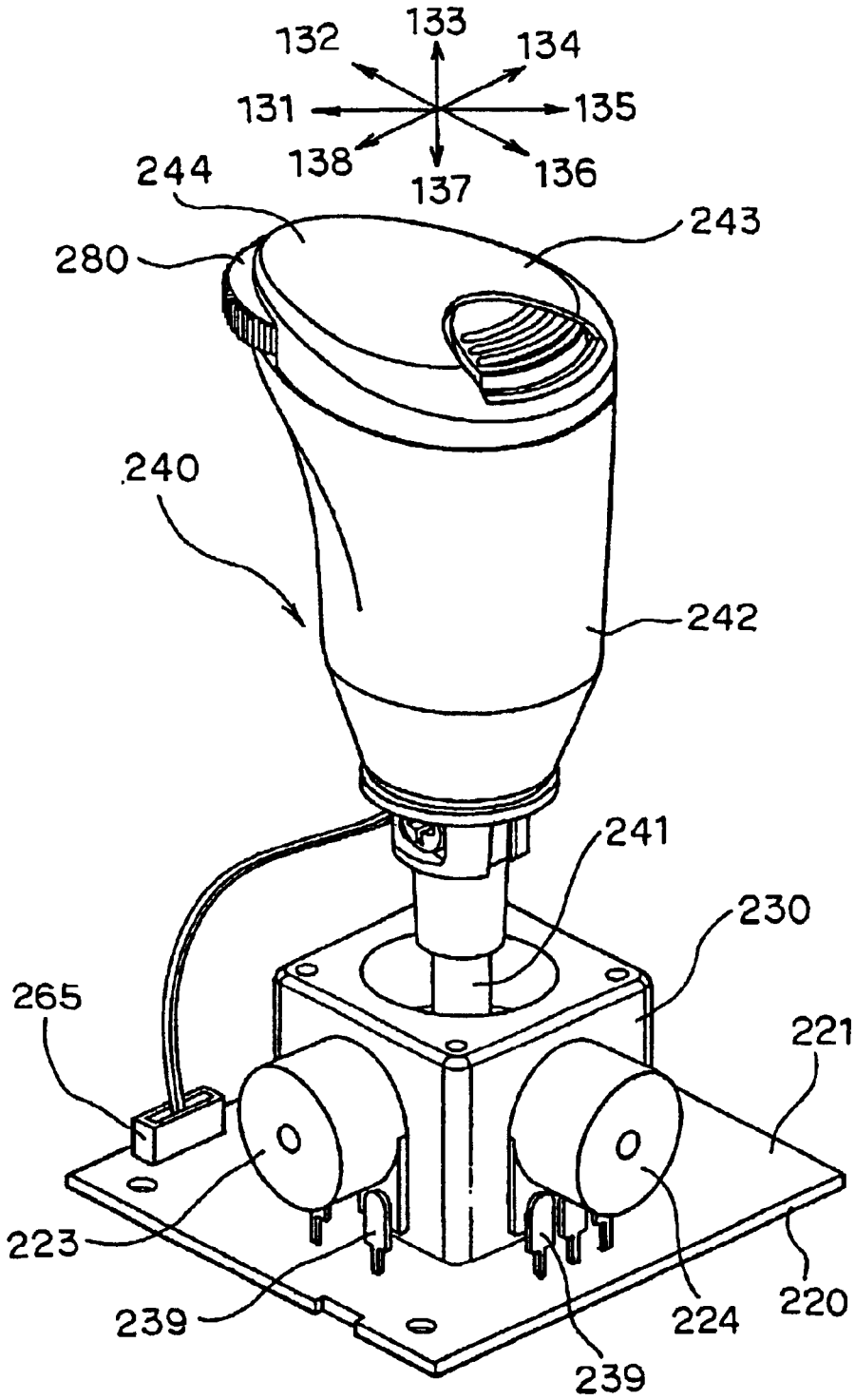
FIG. 8 is a perspective view of an operation lever, a first detecting unit and an operation wheel forming part of the operation lever apparatus shown in FIG. 7.
Figure 9:
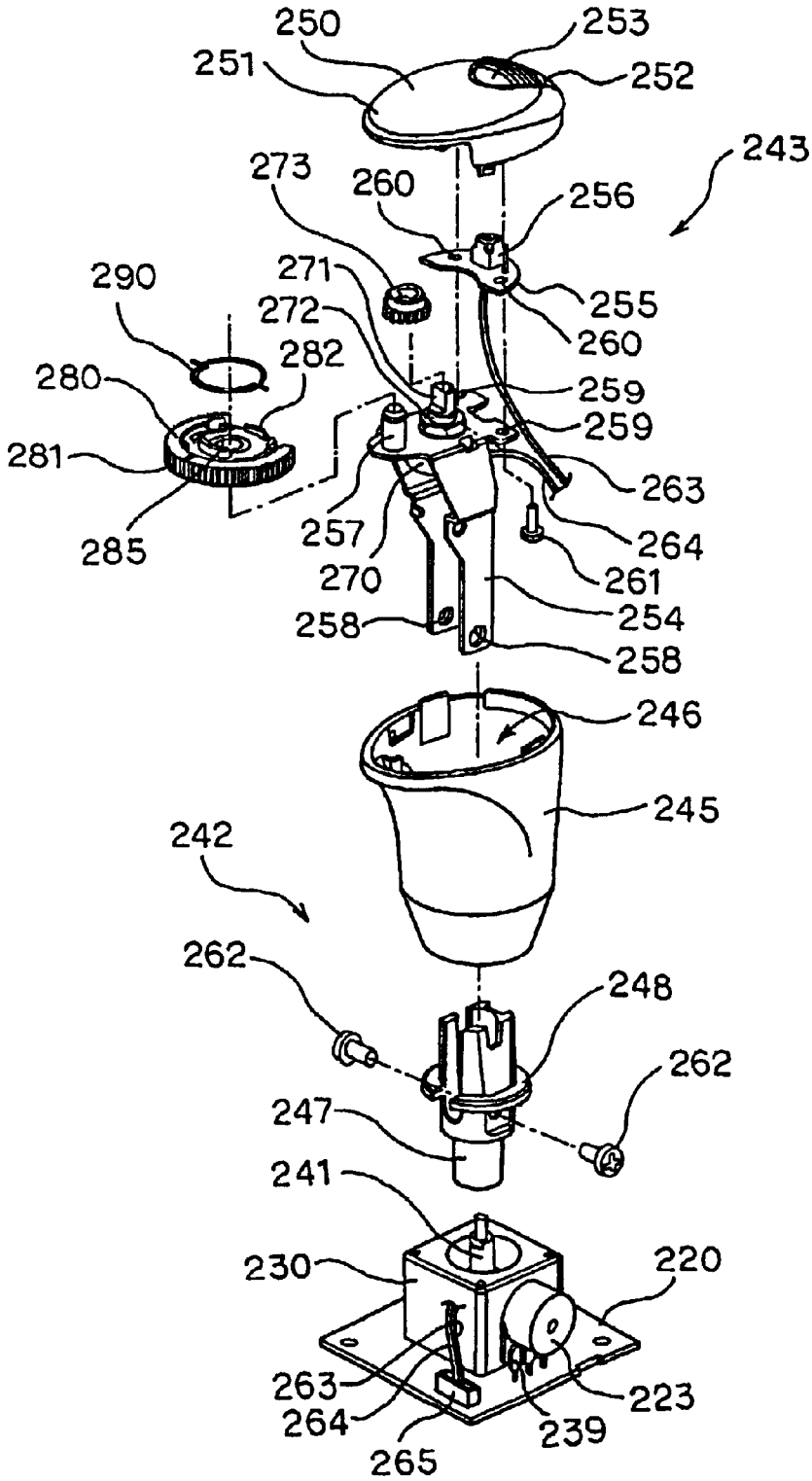
FIG. 9 is an exploded perspective view of an operation lever, a first detecting unit, an operation wheel and a second detecting unit forming part of the operation lever apparatus shown in FIG. 8.
Figure 10:
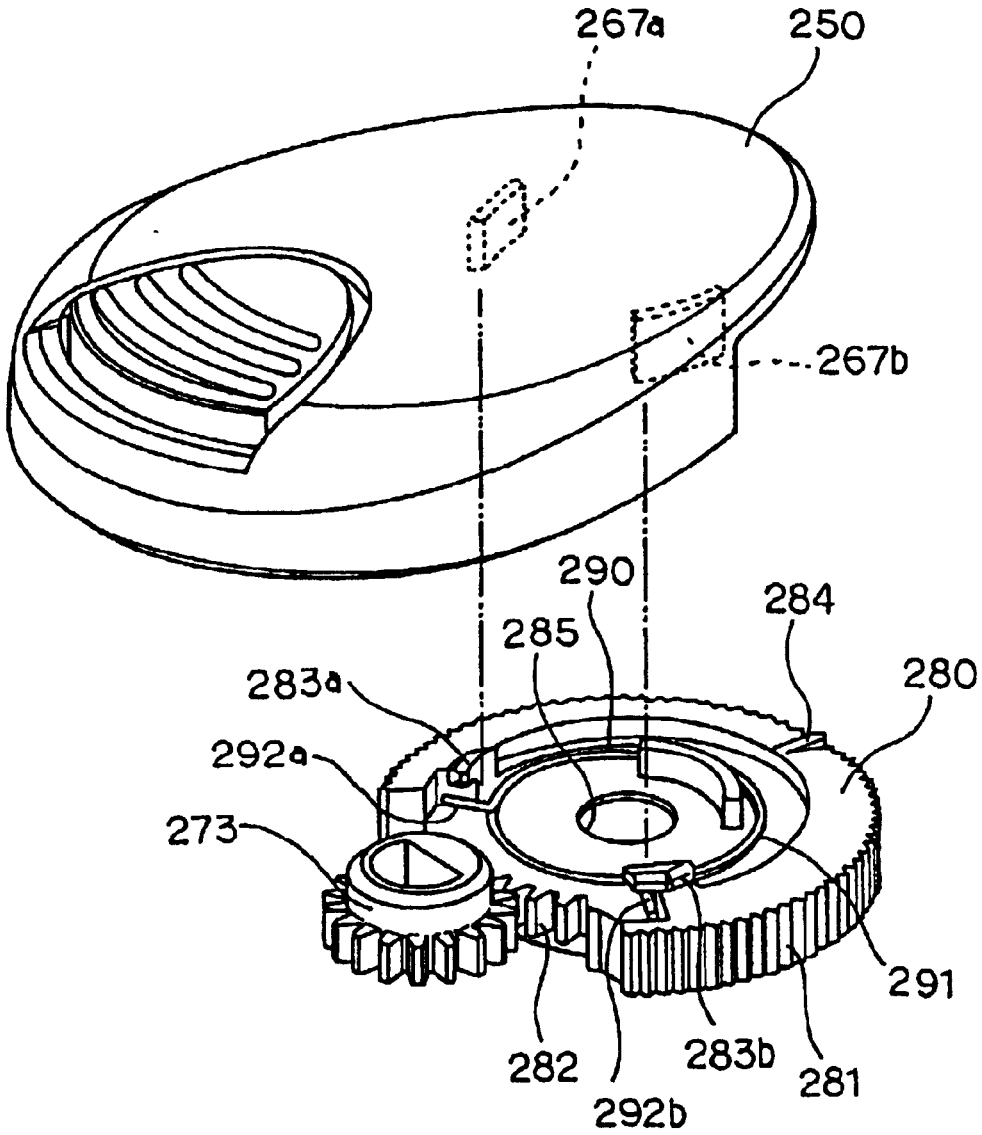
FIG. 10 is an exploded perspective view of a top cover member and an operation wheel forming part of the operation lever apparatus shown in FIG. 8.

The reference axis of the operation lever 240 is tiltable with respect to the reference axis of the first detecting unit 230 in first to eighth tilt directions 131 to 138 each radially outwardly extending from the reference axis of the first detecting unit 230 under the state that the first to eighth tilt directions 131 to 138 of the reference axis of the operation lever 240 are held in equiangularly spaced relationship with each other as shown in FIGS. 4 and 8.

The first detecting unit 230 is operative to produce a tilt direction signal indicative of any one of the first to eighth tilt directions 131 to 138 of the reference axis of the operation lever 240 when the reference axis of the operation lever 240 is tilted with respect to the reference axis of the first detecting unit 230 in any one of the first to eighth tilt directions 131 to 138 of the reference axis of the operation lever 240. The first detecting unit 230 is operative to output the tilt direction signal produced by the first detecting unit 230 to the circuit board 220 through a plurality of terminals 239.

The first detecting unit 230 may be operative to produce a tilt direction signal indicative of neighboring two or more tilt directions selected from among the first to eighth tilt directions 131 to 138 of the reference axis of the operation lever 240 when the reference axis of the operation lever 240 is tilted with respect to the reference axis of the first detecting unit 230 in any one of neighboring two or more tilt directions selected from among the first to eighth tilt directions 131 to 138 of the reference axis of the operation lever 240.

The first detecting unit 230 may also be operative to produce a first tilt direction signal indicative of the first to third tilt directions 131 to 133 of the reference axis of the operation lever 240 when the reference axis of the operation lever 240 is tilted with respect to the reference axis of the first detecting unit 230 in any one of the first to third tilt directions 131 to 133 of the reference axis of the operation lever 240, and a second tilt direction signal indicative of the fifth to seventh tilt directions 135 to 137 of the reference axis of the operation lever 240 when the reference axis of the operation lever 240 is tilted with respect to the reference axis of the first detecting unit 230 in any one of the fifth to seventh tilt directions 135 to 137 of the reference axis of the operation lever 240.

The operation lever apparatus 200 further comprises an operation wheel 280 supported by the operation lever 240 and rockable with respect to the operation lever 240 to assume three different operation positions including first and second positions opposite to each other, and a home position located between the first and second positions of the operation wheel 280, and an urging member 290 intervening between the operation lever 240 and the operation wheel 280 to have the operation wheel 280 resiliently urged to assume the home position of the operation wheel 280.

Figure 11A:
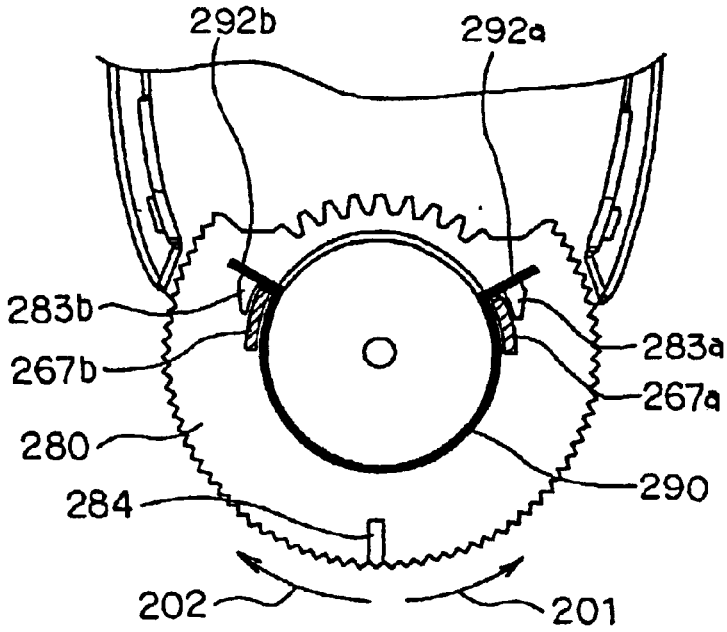
FIG. 11A is an enlarged plan view of an operation wheel and an urging member forming part of the operation lever apparatus shown in FIG. 8.

The operation wheel 280 is disposed at the front end portion 251 of the top cover member 250 of the handle top 243 of the operation lever 240, i.e., the peripheral portion 244 of the handle top 243 of the operation lever 240. The operation wheel 280 has a center axis held in parallel relationship with the reference axis of the operation lever 240 and rockable around the center axis of the operation wheel 280 under the state that the operation wheel 280 is handled by a forefinger of one hand of an operator. The operation wheel 280 being rockable in first and second rock directions 201 and 202 as shown in FIG. 11A.

The operation wheel 280 has a peripheral portion 281 having a plurality of projections, a gear portion 282 smaller in diameter than the peripheral portion 281 of the operation wheel 280, a pair of hook portions 283*a* and 283*b* disposed at both ends of the gear portion 282 of the operation wheel 280, respectively, and a marker portion 284 disposed on the middle point of the peripheral portion 281 of the operation wheel 280 in equiangularly spaced relationship with both ends of the peripheral portion 281 of the operation wheel 280.

The operation wheel 280 is formed with a central hole 285 and disposed between the top cover member 250 of the handle top 243 of the operation lever 240 and the chassis 254 of the handle top 243 of the operation lever 240 under the state that the pin 257 of the handle top 243 of the operation lever 240 is received in the central hole 285 of the operation wheel 280.

The urging member 290 is constituted by a coil spring and has a winding portion 291 in the form of a helical shape and winding around the center axis of the operation wheel 280, and a pair of projecting portions 292*a* and 292*b* each integrally formed with the winding portion 291 of the urging member 290 and radially outwardly projecting from both ends of the urging member 290. The top cover member 250 of the handle top 243 of the operation lever 240 has a pair of holding portions 267*a* and 267*b* each projecting toward the operation wheel 280.

The operation wheel 280 is resiliently urged by the urging member 290 to assume the home position of the operation wheel 280 under the state that the projecting portions 292*a* and 292*b* of the urging member 290 are held in contact with the holding portions 267*a* and 267*b* of the top cover member 250 of the handle top 243 of the operation lever 240 and the hook portions 283*a* and 283*b* of the operation wheel 280, respectively, when the operation wheel 280 is located in the home position of the operation wheel 280 as shown in FIG. 11A.

Figure 11B:
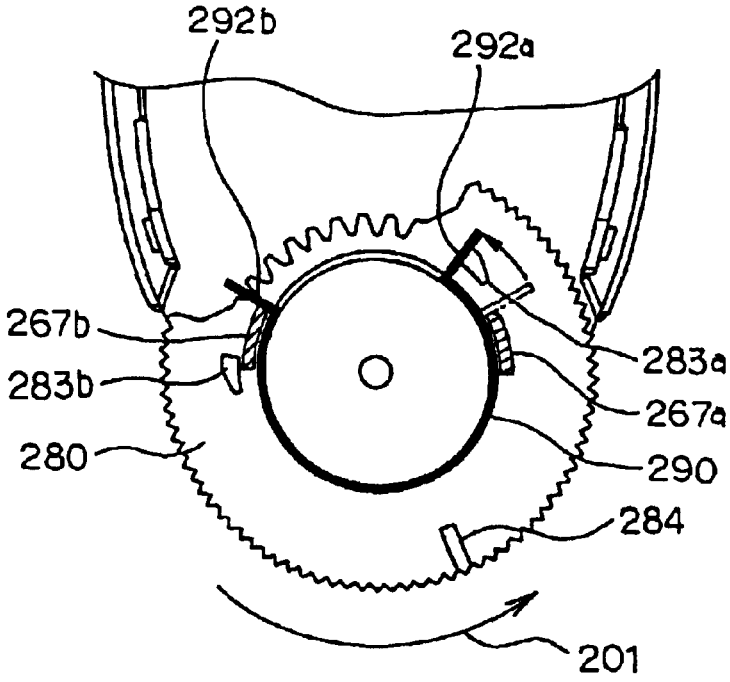
FIG. 11B is an enlarged plan view of an operation wheel and an urging member forming part of the operation lever apparatus shown in FIG. 8.
Figure 12:
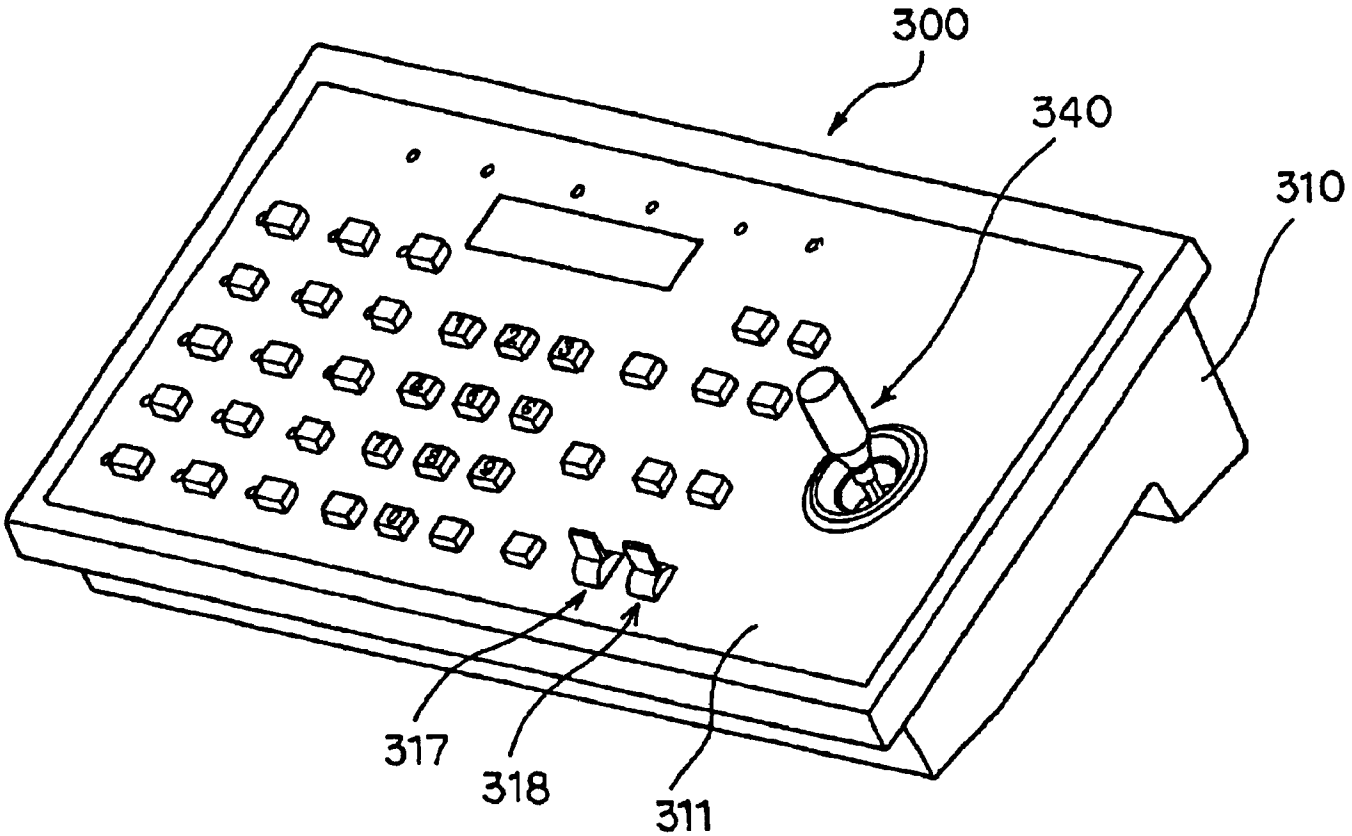
FIG. 12 PRIOR ART
FIG. 12 is a perspective view of a conventional operation lever apparatus.
Figure 13:
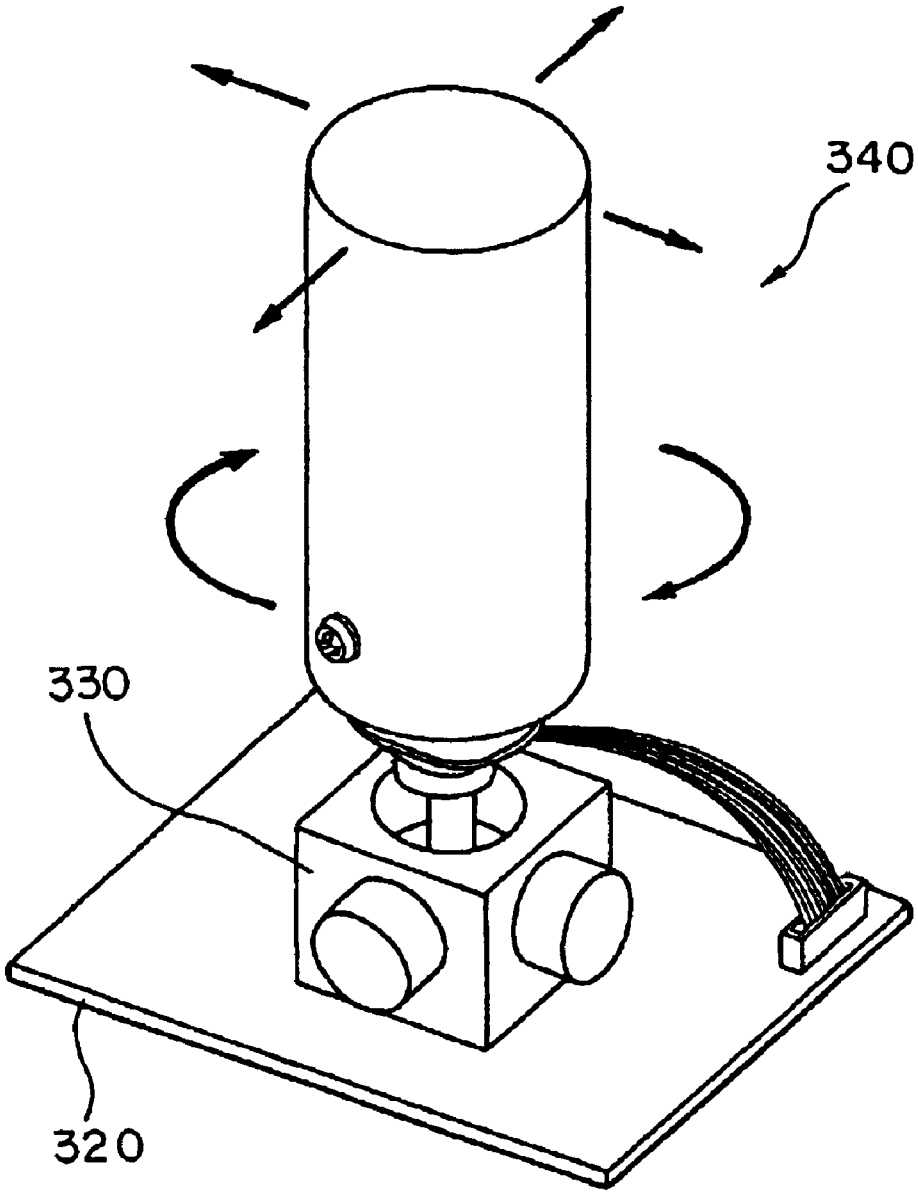
FIG. 13 PRIOR ART
FIG. 13 is a perspective view of an operation lever and a detecting unit forming part of the conventional operation lever apparatus shown in FIG. 12.

The operation wheel 280 is resiliently urged by the urging member 290 to assume the home position of the operation wheel 280 under the state that the projecting portion 292*b* of the urging member 290 is held in contact with the holding portion 267*b* of the top cover member 250 of the handle top 243 of the operation lever 240 with the projecting portion 292*a* of the urging member 290 being pushed by the hook portion 283*a* of the operation wheel 280 when the operation wheel 280 is rocked in the first rock direction 201 to assume the first position of the operation wheel 280 as shown in FIG. 11B.

The operation wheel 280 is resiliently urged by the urging member 290 to assume the home position of the operation wheel 280 under the state that the projecting portion 292*a* of the urging member 290 is held in contact with the holding portion 267*a* of the top cover member 250 of the handle top 243 of the operation lever 240 with the projecting portion 292*b* of the urging member 290 being pushed by the hook portion 283*b* of the operation wheel 280 when the operation wheel 280 is rocked in the second rock direction 202 to assume the second position of the operation wheel 280.

The operation lever apparatus 200 further comprises second detecting means constituted by a second detecting unit 270 designed to detect a rock direction of the operation wheel 280 with respect to the operation lever 240.

The second detecting unit 270 is operative to produce a rock direction signal indicative of the rock direction of the operation wheel 280 when the operation wheel 280 is rocked with respect to the operation lever 240 in the first and second rock directions 201 and 202 of the operation wheel 280.

The second detecting unit 270 has an axle portion 271 and secured to the chassis 254 of the handle top 243 of the operation lever 240 by a nut 272 tightened to the second detecting unit 270. The second detecting unit 270 includes a gear member 273 intervening between the operation wheel 280 and the second detecting unit 270 to transmit the rotation of the operation wheel 280 to the second detecting unit 270. The gear member 273 of the second detecting unit 270 is secured to the axle portion 271 of the second detecting unit 270 and held in mesh with the gear portion 282 of the operation wheel 280.

The second detecting unit 270 is operative to output the rock direction signal produced by the second detecting unit 270 to the circuit board 220 through a cable 264 electrically connected at one end to the second detecting unit 270 and electrically connected at the other end to the circuit board 220 through the connector 265.

The operation lever apparatus 200 further comprises camera control means constituted by the circuit board 220 designed to issue a plurality of instruction signals to the surveillance camera to control various operations of the surveillance camera. The instruction signals are constituted by the tilt direction signal produced by the first detecting unit 230, the rock direction signal produced by the second detecting unit 270, and the pushed state signal produced by the switch unit 256 of the handle top 243 of the operation lever 240.

The camera control means 220 is operative to control a shooting direction of the surveillance camera on the basis of the tilt direction signal produced by the first detecting unit 230, a zooming operation of the surveillance camera on the basis of the rock direction signal produced by the second detecting unit 270, and a focusing operation of the surveillance camera on the basis of the pushed state signal produced by the switch unit 256 of the handle top 243 of the operation lever 240.

As will be seen from the foregoing description, the second embodiment of the operation lever apparatus according to the present invention makes it possible 1) to be increased in number of the instruction signals under the state that the operation lever apparatus is handled by one hand of an operator, and 2) to be operated by one hand of an operator with ease.

While the present invention has thus been shown and described with reference to the specific embodiments, however, it should be noted that the invention is not limited to the details of the illustrated structures but changes and modifications may be made without departing from the scope of the appended claims.

What is claimed is:

1. An operation lever apparatus operative in combination with a surveillance system having a camera unit operable in zoomed and focused states, said camera unit being movable in a shooting direction in which said camera unit is adapted to shoot a picture, comprising:

a retaining member having a reference axis;

a first operation lever having a center axis and mounted on said retaining member, said first operation lever being movable with respect to said retaining member to assume two different operation positions including a first position in which said center axis of said first operation lever is held in coaxial relationship with said reference axis of said retaining member, and a second position in which said center axis of said first operation lever is tilted with respect to said reference axis of said retaining member;

first detecting means for detecting a tilt direction of said center axis of said first operation lever with respect to said reference axis of said retaining member;

a second operation lever having a center axis and mounted on said first operation lever, said second operation lever being movable with respect to said first operation lever to assume two different operation positions including a first position in which said center axis of said second operation lever is held in coaxial relationship with said center axis of said first operation lever, and a second position in which said center axis of said second operation lever is tilted with respect to said center axis of said first operation lever; and second detecting means for detecting a tilt direction of said center axis of said second operation lever with respect to said center axis of said first operation lever;

said second operation lever being axially movable alone said center axis of said second operation lever and operative to assume two different operation states including a pushed state in which said second operation lever is axially moved toward said first operation lever and a released state in which said second operation lever is axially moved away from said first operation lever, and in which said second detecting means is operative to detect said pushed state of said second operation lever member, and which further comprises:

camera control means for controlling said camera unit in said shooting direction, said zoomed state, and said focused state on the basis of said tilt direction of said center axis of said first operation lever with respect to said reference axis of said retaining member, said tilt direction of said center axis of said second operation lever with respect to said center axis of said first operation lever, and said pushed state signal produced by said second detecting unit.

2. An operation lever apparatus as set forth in claim 1, in which said handle has a top portion, and in which said second operation lever being mounted on said top portion of said handle of said first operation lever.

3. An operation lever apparatus as set forth in claim 1, in which said center axis of said first operation lever is tiltable with respect to said reference axis of said first retaining member in first to eighth tilt directions each radially outwardly extending from said reference axis of said first retaining member under the state that said first to eighth tilt directions of said center axis of said first operation lever are held in equi-angularly spaced relationship with each other, and in which said first detecting means is operative to produce a tilt direction signal indicative of neighboring two or more tilt directions selected from among said first to eighth tilt directions of said center axis of said first operation lever when said center axis of said first operation lever is tilted with respect to said reference axis of said first retaining member in any one of neighboring two or more tilt directions selected from among said first to eighth tilt directions of said center axis of said first operation lever.

4. An operation lever apparatus as set forth in claim 3, in which said first detecting means is operative to produce a first tilt direction signal indicative of said first to third tilt directions of said center axis of said first operation lever when said center axis of said first operation lever is tilted with respect to said reference axis of said first retaining member in any one of said first to third tilt directions of said center axis of said first operation lever, and a second tilt direction signal indicative of said fifth to seventh tilt directions of said center axis of said first operation lever when said center axis of said first operation lever is tilted with respect to said reference axis of said first retaining member in any one of said fifth to seventh tilt directions of said center axis of said first operation lever.

5. An operation lever apparatus as set forth in claim 3, in which said first detecting means is operative to produce a first tilt direction signal indicative of said first to fourth tilt directions of said center axis of said first operation lever when said center axis of said first operation lever is tilted with respect to said reference axis of said first retaining member in any one of said first to fourth tilt directions of said center axis of said first operation lever, and a second tilt direction signal indicative of said fifth to eighth tilt directions of said center axis of said first operation lever when said center axis of said first operation lever is tilted with respect to said reference axis of said first retaining member in any one of said fifth to eighth tilt directions of said center axis of said first operation lever.

6. An operation lever apparatus as set forth in claim 1, in which said center axis of said second operation lever is tiltable with respect to said center axis of said first operation lever in first to eighth tilt directions each radially outwardly extending from said center axis of said first operation lever under the state that said first to eighth tilt directions of said center axis of said second operation lever are held in equi-angularly spaced relationship with each other, and in which said second detecting means is operative to produce a tilt direction signal indicative of neighboring two or more tilt directions selected from among said first to eighth tilt directions of said center axis of said second operation lever when said center axis of said second operation lever is tilted with respect to said reference axis of said second retaining member in any one of neighboring two or more tilt directions selected from among said first to eighth tilt directions of said center axis of said second operation lever.

7. An operation lever apparatus as set forth in claim 6, in which said second detecting means is operative to produce a first tilt direction signal indicative of said first to third tilt directions of said center axis of said second operation lever when said center axis of said second operation lever is tilted with respect to said center axis of said first operation lever in any one of said first to third tilt directions of said center axis of said second operation lever, and a second tilt direction signal indicative of said fifth to seventh tilt directions of said center axis of said second operation lever when said center axis of said second operation lever is tilted with respect to said center axis of said first operation lever in any one of said fifth to seventh tilt directions of said center axis of said second operation lever.

8. An operation lever apparatus as set forth in claim 6, in which said second detecting means is operative to produce a first tilt direction signal indicative of said first to fourth tilt directions of said center axis of said second operation lever when said center axis of said second operation lever is tilted with respect to said center axis of said first operation lever in any one of said first to fourth tilt directions of said center axis of said second operation lever, and a second tilt direction signal indicative of said first to eighth tilt directions of said center axis of said second operation lever when said center axis of said second operation lever is tilted with respect to said center axis of said first operation lever in any one of said fifth to eighth tilt directions of said center axis of said second operation lever.

9. An operation lever apparatus as set forth in claim 1, in which said first operation lever includes a rod coupled at one end to said first detecting unit, and a handle secured to said other end of said rod of said first operation lever, said handle of said first operation lever includes a cover member formed with a cover space, and a coupling member intervening between said rod of said first operation lever and said cover member of said handle of said first operation lever to have said cover member of said handle of said first operation lever supported by said rod of said first operation lever therethrough.

* * * * *

UNITED STATES PATENT AND TRADEMARK OFFICE

CERTIFICATE OF CORRECTION

PATENT NO. : 6,865,342 B2
DATED : March 8, 2005
INVENTOR(S) : Hirata et al.

It is certified that error appears in the above-identified patent and that said Letters Patent is hereby corrected as shown below:

Column 18,
Line 21, please delete “alone” and insert therefor -- along --.

Signed and Sealed this

Thirty-first Day of May, 2005

JON W. DUDAS
*Director of the United States Patent and Trademark Office*